US006336790B1

(12) United States Patent
Jacobsson

(10) Patent No.: US 6,336,790 B1
(45) **Date of Patent: *Jan. 8, 2002**

(54) AXIAL FLOW POWER TOOL TURBINE MACHINE

(75) Inventor: Rolf Alexis Jacobsson, Saltsjö-Boo (SE)

(73) Assignee: Atlas Copco Tools A.B., Nacka (SE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/951,270

(22) Filed: Oct. 17, 1997

(30) Foreign Application Priority Data

Oct. 18, 1996 (SE) ..... 9603835

(51) Int. Cl.[7] ..... F01D 1/04

(52) U.S. Cl. ..... 415/189; 415/191; 415/209.1; 415/209.2; 415/199.5; 415/904

(58) Field of Search ..... 415/199.4, 199.5, 415/189, 190, 191, 208.2, 209.1, 209.2, 209.3, 209.4, 903, 904; 29/557, 558, 889.2; 409/131, 132, 143, 199, 200; 451/51, 61

(56) References Cited

U.S. PATENT DOCUMENTS

| | | | | | |
|---|---|---|---|---|---|
| 2,565,925 | A | * | 8/1951 | Lombard et al. | 409/131 |
| 2,633,776 | A | * | 4/1953 | Schenk | 409/132 |
| 2,638,136 | A | * | 5/1953 | Miller | 409/199 |
| 2,962,941 | A | * | 12/1960 | Stein et al. | 416/243 |
| 3,043,559 | A | * | 7/1962 | Bauer et al. | 415/138 |
| 3,241,493 | A | * | 3/1966 | Frey | 415/199.5 |
| 3,709,630 | A | | 1/1973 | Pohl et al. | |
| 4,218,180 | A | * | 8/1980 | Wikstrom | 415/199.5 |
| 5,180,281 | A | * | 1/1993 | Burge et al. | 415/209.2 |
| 5,482,433 | A | | 1/1996 | Norris et al. | |
| 5,564,897 | A | | 10/1996 | Mansson | |

FOREIGN PATENT DOCUMENTS

| | | | | |
|---|---|---|---|---|
| CH | 383734 | * | 1/1965 | 29/889.2 |
| CH | 661678 | * | 8/1987 | 409/131 |
| DE | 560836 | * | 9/1932 | |
| DE | 732767 | * | 3/1943 | 29/889.2 |
| DK | 91048 | * | 8/1961 | 415/199.5 |
| EP | 0 718 469 | | 6/1996 | |
| FR | 630558 | * | 12/1927 | 415/199.5 |
| FR | 633074 | * | 1/1928 | 415/199.5 |
| GB | 817957 | * | 8/1959 | 415/199.5 |
| GB | 909058 | | 10/1962 | |
| GB | 1 287 850 | | 9/1972 | |
| GB | 1390979 | | 4/1975 | |
| GB | 2250782 | | 6/1992 | |

* cited by examiner

*Primary Examiner*—Christopher Verdier
(74) *Attorney, Agent, or Firm*—Frishauf, Holtz, Goodman, Langer & Chick, P.C.

(57) ABSTRACT

An axial flow power tool turbine motor for operation with an elastic fluid, like pressured air, includes a housing (12), a rotor (11) rotatively journalled in the housing (12) and formed in one piece with drive blades (24) arranged in axially spaced circumferential rows (C, A, C, E, G, I, K), and a stator (10) in the form of a tubular body (22) which is immovably supported in the housing (12) and which carries internal guide vanes (23) arranged in circumferential rows (B, D, F, H, J), wherein the tubular stator body (22) is divided into three longitudinal sections (22*a*, 22*b*, 22*c*) with which the guide vanes (23) are integrally formed, and a retainer (27, 29) for fixing and mounting the longitudinal sections (22*a*, 22*b*, 22*c*) in accurately defined relative positions to form the tubular stator body (22).

6 Claims, 2 Drawing Sheets

AXIAL FLOW POWER TOOL TURBINE MACHINE

This invention relates to an axial flow turbine machine for operation with an elastic fluid.

In particular, the invention concerns an axial flow turbine machine comprising two or more expansion or compression stages, i.e. having a rotor carrying drive blades arranged in two or more axially spaced circumferential rows and a stator carrying guide vanes arranged in one or more circumferential rows, wherein each one of the rows of guide vanes is disposed between two adjacent rows of drive blades.

BACKGROUND OF THE INVENTION

In prior art, it is well known to produce multi-stage turbine machines by forming both the rotor and the stator in a number of sections to be assembled into a complete rotor and a complete stator. In bigger turbines, the guide vanes are formed as separate parts for mounting in rows in the stator, and the stator is divided into two longitudinal halves to be put together around the rotor, whereby the guide vane rows are introduced between the drive blade rows.

However, when producing small size turbines having a diameter of only 30–40 mm, it is not practically possible to use separate guide vanes in the stator. The radial size of the guide vanes in the high pressure stage may be as small as a fraction of a millimeter. Such small vanes have to be formed integral with the stator by machining or molding.

In British Patent No. 1 287 850, there is described a small size two-stage turbine in which the rotor is formed in one piece, including two rows of drive blades. Since the drive blades extend from an outer cylindrical surface, there is no problem machining them from the rotor body. The stator of this known turbine comprises one row of guide vanes which is located between the drive blade rows and which is formed by two semicircular ring elements provided with guide vanes on their outside. This means that the guide vanes are easily machinable from the outer surface of the ring elements.

On the other hand, this prior art guide vane arrangement means that the turbine is rather complicated as it comprises not only separate ring elements to form the stator but also separate sleeve elements for accomplishing an axial clamping of the ring elements in the housing. This also means that there is a nonfavourable air flow path through the turbine, because the guide vanes have a bigger radial extent than the drive blades for enabling the axial clamping of the stator ring elements. Thus, the air flow path is locally enlarged in the stator, which causes an undesirable turbulent air flow therethrough.

OBJECT OF THE INVENTION

The primary object of the invention is to accomplish an axial flow turbine machine having two or more expansion or compression stages and which is inexpensive and easy both to manufacture and to assemble and which is suitable for production in small sizes.

A preferred embodiment of the invention is below described in detail with reference to the accompanying drawings.

BRIEF DESCRIPTION OF THE INVENTION

DETAILED DESCRIPTION

Figure 1:
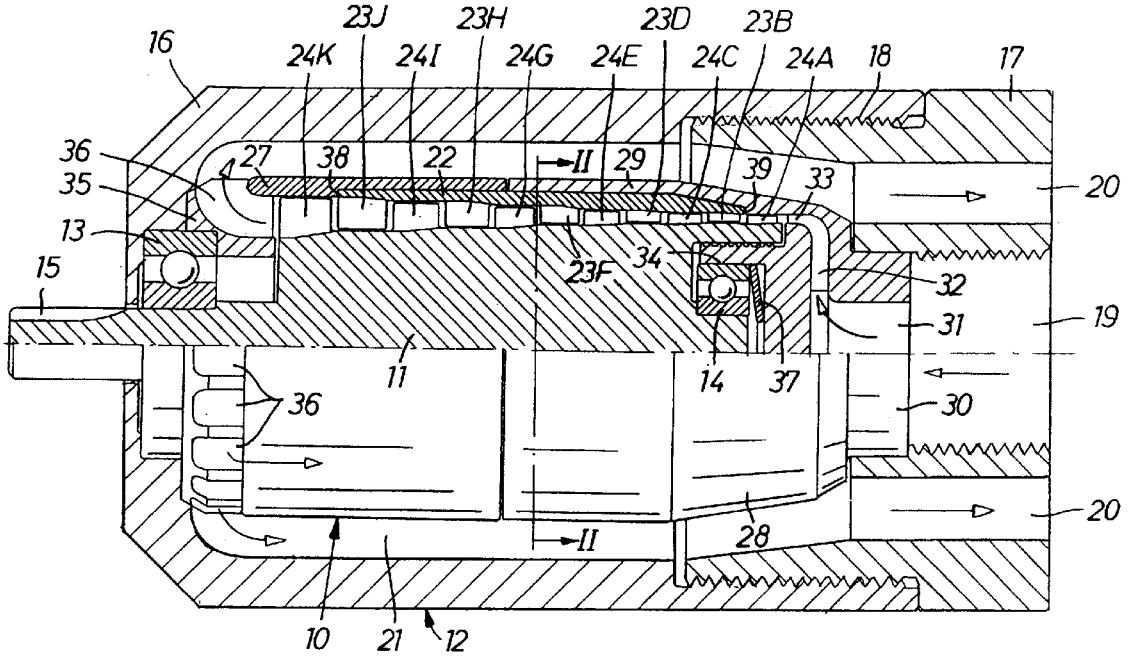
FIG. 1 shows a longitudinal section through a turbine according to the invention.

The turbine illustrated in the drawing figures is a six stage pneumatic motor comprising a stator 10, a rotor 11 and a cylindrical housing 12. The stator 10 is immovably secured in the housing 12, whereas the rotor 11 is rotatively journalled in the housing 12 by means of two roller bearings 13, 14. The rotor 11 also comprises a splined output end 15 for connection to a reduction gearing (not shown).

The housing 12 comprises a forward section 16 and a rear section 17 which are rigidly interconnected by a thread connection 18. A pressure air inlet passage 19 extends coaxially through the rear housing section 17, and a number of parallel air exhaust passages 20 in the rear section 17 communicate with a tubular exhaust chamber 21 formed between the forward housing section 16 inner wall and the stator 10. The air flow through the turbine is illustrated by arrows in FIG. 1.

The stator 10 comprises a tubular body or sleeve 22 carrying inwardly directed guide vanes 23 which are arranged in five axially spaced circumferential rows B, D, F, H, and J, whereas the rotor 11 is provided with drive blades 24 arranged in six axially spaced circumferential rows A, C, E, G, I, and K. See FIG. 1. In a common manner, the drive blades 24 and the guide vanes 23 are disposed in alternating positions, viewed in the direction of the motive pressure air flow through the turbine. This means that between adjacent rows of drive blades 24 there is a row of guide vanes 23 for linking the pressure air flow into an optimum direction before entering the next row of drive blades 24.

In the drawings, the reference numerals of the drive blades 24 and the guide vanes 23 are combined with the reference letters of the circumferential rows A, C, E, G, I, and K and B, D, F, H, and J, respectively, in which they are arranged.

In order to simplify this specification, however, these suffix letters are omitted in the text, which means that all the drive blades are simply referred to as 24 and all the guide vanes are referred to as 23. Apart from the differences in size, all of the drive blades 24 have the same functional features. All of the guide vanes 23 also have the same functional features.

The stator 10 further comprises a forward mounting sleeve 27, forming an outer support for the sleeve 22, and a rear cup shaped nozzle piece 28. The latter has a forwardly directed tubular skirt portion 29 for radial support of the sleeve 22 and a rear air inlet portion 30. This portion is formed with an air inlet opening 31 communicating at its one end with the air inlet passage 19 and at its other end with radially directed air feed passages 32. These air feed passages 32 communicate motive pressure air from the inlet portion 30 to a number of air nozzles 33 by which the motive high speed air flow through the turbine is generated. The nozzle piece 28 also comprises a socket 34 forming a support for the rear rotor bearing 14.

At its front end, the stator 10 also comprises a ring element 35 which forms a radial as well as an axial support for the mounting sleeve 27. The ring element 35 is formed with a number of exhaust openings 36 communicating with the exhaust chamber 21.

The motor turbine illustrated in the drawings is intended to be produced in small dimensions, i.e. having a rotor diameter from about 30–40 mm. Accordingly, the rotor drive blades 24 as well as the guide vanes 23 on the stator sleeve 22 are of such small sizes that it is not possible to produce them as separate details for mounting on the respective carrier. Instead, the drive blades 24 and the guide vanes 23 are machined out as integrated parts of the rotor 11 and the stator sleeve 22, respectively. Since the drive blades 24 are located on the outer surface of the rotor body 11, there is no problem to carry out the necessary machining work, for instance by a shank end mill.

Figure 2:
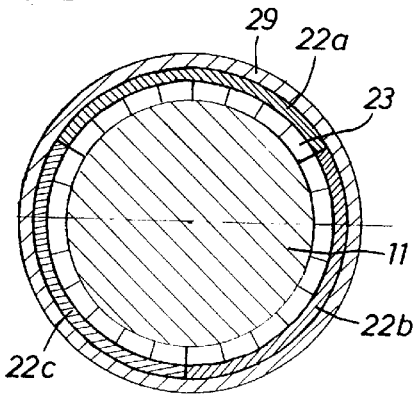
FIG. 2 shows a cross section along line II—II in FIG. 1.

However, to be able to form the guide vanes 23 on the inside of the stator sleeve 22, the latter is divided into three separate shells 22*a*, 22*b* and 22*c*. See FIG. 2. These shells are divided along three cylinder generatrices located at 120 degrees intervals, which means that each shell has a circumferential extent of 120 degrees.

As the turbine is assembled, the shells 22*a*, 22*b* and 22*c* are kept together in a fixed radial relationship by the forward mounting sleeve 27 and the tubular skirt portion 29 of the nozzle piece 28. The mounting sleeve 27 and the skirt portion 29 surround the shells 22*a*, 22*b*, 22*c* with a tight fit such that the positions of the shells 22*a*, 22*b* and 22*c* are accurately defined so as to form the tubular sleeve body 22. The stator shells 22*a*, 22*b* and 22*c* are secured relative to the housing 12 by axial clamping between a shoulder 38 on the forward mounting sleeve 27 and a shoulder 39 on the nozzle piece skirt portion 29. The clamping force is obtained by the thread connection 18 between the two housing sections 16 and 17.

Scattering of the detail dimensions within the production tolerances is compensated for by a Belleville-type spring washer 37 which is disposed in the socket 34 behind the rear bearing 14 to ensure a correct axial load on the rotor bearings.

Figure 3:
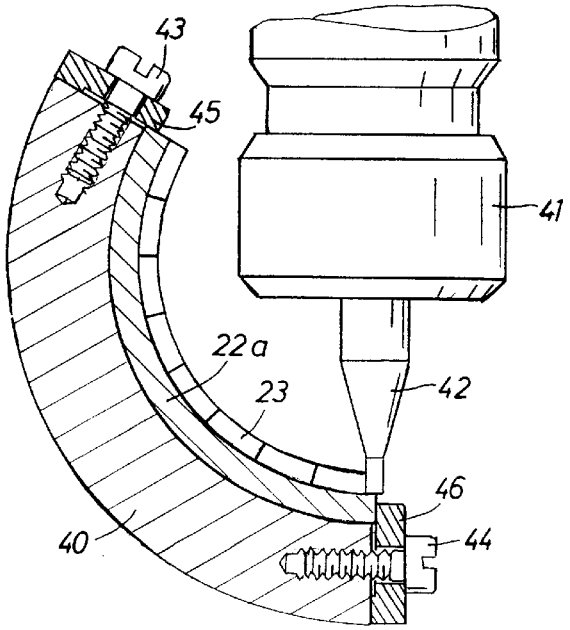
FIG. 3 illustrates a machining process in which the guide vanes of a stator section are formed by milling.

In FIG.3, there is illustrated a machining situation wherein one of the stator shells 22*a* is firmly clamped against a part cylindrical surface of a fixture 40, and a milling spindle 41 fitted with a shank end mill 42 is in a position for machining a guide vane at the longitudinal edge of the shell. The shell is clamped in this position by means of screws 43, 44 and clamp rules 45, 46 carried on the fixture. This illustrated machining situation intends to show that machining of the guide vanes close to the edges of a stator shell would not be possible with a 180 degree two part divided stator. Each shell has to have a circumferential extent well below 180 degrees to give access to a machining tool.

Figure 4:
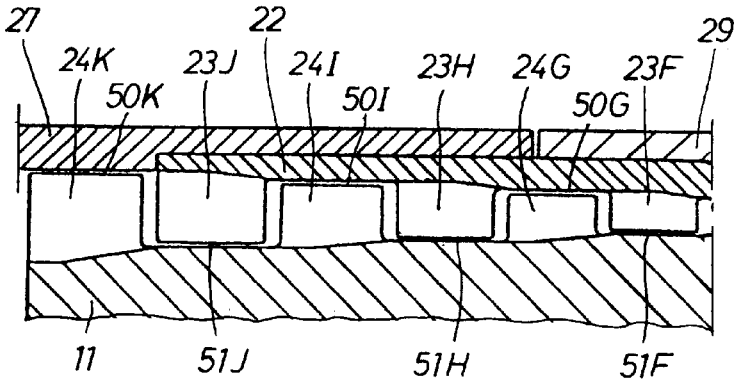
FIG. 4 shows, on a larger scale, a fraction of the longitudinal section in FIG. 1.

As illustrated in FIG. 4, the extreme free ends of the drive blades 24 and guide vanes 23 form clearance seals with cylindrical surfaces 50 and 51 on the stator 10 and the rotor 11, respectively. The drive blades 24 in each circumferential row A, C, E, G, I, and K cooperate sealingly with a corresponding cylindrical surface 50 on the stator 10. It is to be noted that the drive blade and sealing surface reference numerals in FIGS. 1 and 4 are provided with the suffix letter of the corresponding circumferential row.

In the same way, the extreme free ends of the guide vanes 23 in each circumferential row B, D, F, H, and J cooperate sealingly with a cylindrical surface 51 on the rotor 11. The reference numerals of the guide vanes and sealing surface in the drawing figures are provided with the suffix letter of the corresponding circumferential row. Although, the last three stages only of the turbine are shown in FIG. 4, i.e. the drive blade rows G, I and K and the guide vane rows F,H, and J, the clearance seal arrangement with cylindrical sealing surfaces 50 and 51 on the stator 10 and the rotor 11, respectively, is similar in all turbine stages.

By having the drive blades 24 and guide vanes 23 form clearance seals together with cylindrical surfaces 50 and 51, respectively, there is obtained the advantage of allowing a certain axial adjustment of the rotor 11 relative to the stator 10 without influencing on the clearance seals.

It is to be noted that the embodiments of the invention are not limited to the shown and described example but can be freely varied within the scope of the claims.

For example, the circumferential extent of the stator shells does not have to be exactly the same. The important thing is that the guide vanes 23 are formed in one piece with and on the inside of the tubular stator body formed by the shells. To enable this, the tubular body 22 has to be divided into three or more sections or shells each having a circumferential extent well below 180 degrees.

In an alternative embodiment of the invention the stator shells 22*a*, 22*b*, 22*c* are fixed and mounted relative to each other by joints engaging external flanges located at the longitudinal edges of the shells. This method for fixing and mounting the stator shells is well known per se at bigger two-part turbine stators.

What is claimed is:

1. A small-size axial flow power tool turbine rotor or operation with an elastic fluid, said turbine motor comprising:

a housing;

a rotor journalled in said housing and carrying a plurality of drive blades, said drive blades being integrally formed with said rotor as a one piece -member, and said drive blades being arranged in three or more axially spaced circumferential rows; and a stator supported in said housing, said stator comprising a tubular body having a number of guide vanes formed therein which are arranged in two or more circumferential rows on an inside surface of said tubular body such that each one of said two or more circumferential rows of guide vanes is disposed between adjacent ones of said three or more axially spaced circumferential rows of drive blades;

wherein said tubular body is cylindrical in shape and divided along at least three cylinder generatrices into at leas three longitudinal sections which each extend along an axial length of said tubular body over all of said two or more circumferential rows of guide vanes;

wherein said guide vanes are integrally formed on said at least three longitudinal sections; and wherein a retainer is provided for fixing and mounting said at least three longitudinal sections in accurately defined relative positions; and wherein free ends of said drive blades and said guide vanes form clearance seals with cylindrical surfaces on the stator and the rotor, respectively.

2. A turbine motor according to claim 1, wherein each one of said at least three longitudinal sections extends over a circumferential angle which is less than 180 degrees of the stator circumference.

3. A turbine motor according to claim 2 wherein said tubular body is divided into exactly three longitudinal sections, and each one of said longitudinal section extends over a circumferential angle of 120 degrees of the stator circumference.

4. A turbine motor according to claim 3, wherein said retainer comprises at least one sleeve element which is tightly fitted around said tubular body.

5. A turbine motor according to claim 2, wherein said retainer comprises at least one sleeve element which is tightly fitted around said tubular body.

6. A turbine motor according to claim 1, wherein said retainer comprises at least one sleeve element which is tightly fitted around said tubular body.

* * * * *